United States Patent [19]

Frezza

[11] 4,305,185

[45] Dec. 15, 1981

[54] ADJUSTABLE SPREADER FOR TUBULAR KNITTED FABRIC

[75] Inventor: Robert Frezza, Carle Place, N.Y.

[73] Assignee: Samcoe Holding Corporation, Woodside, N.Y.

[21] Appl. No.: 90,342

[22] Filed: Nov. 1, 1979

Related U.S. Application Data

[62] Division of Ser. No. 888,135, Mar. 20, 1978, Pat. No. 4,192,045.

[51] Int. Cl.[3] ..... D06C 5/00

[52] U.S. Cl. ..... 26/75; 26/84

[58] Field of Search ..... 26/74, 75, 76, 80, 83, 26/84, 85

[56] References Cited

U.S. PATENT DOCUMENTS

| | | | |
|---|---|---|---|
| 2,228,001 | 1/1941 | Cohn et al. . | |
| 2,583,630 | 1/1952 | Chatfield . | |
| 2,826,802 | 3/1958 | Beard | 26/80 |
| 2,838,823 | 6/1958 | Miller | 26/83 |
| 3,239,618 | 3/1966 | Sengel | 26/76 X |
| 3,854,596 | 12/1974 | Stephenson et al. | 213/43 X |
| 3,864,922 | 2/1975 | Dial et al. | 267/65 R X |
| 3,875,624 | 4/1975 | Frezza | 26/84 X |
| 3,937,450 | 2/1976 | Bauer | 267/65 R X |
| 4,079,925 | 3/1978 | Salin | 267/65 R X |
| 4,103,402 | 8/1978 | Frezza | 26/84 X |

FOREIGN PATENT DOCUMENTS

| | | | |
|---|---|---|---|
| 46-29998 | 8/1971 | Japan | 26/83 |
| 426708 | 6/1967 | Switzerland | 26/84 |

OTHER PUBLICATIONS

The Gas Spring, Gas Spring Corporation, Montgomeryville Pa., 4 pp.

*Primary Examiner*—Robert Mackey

[57] ABSTRACT

The disclosure is directed to apparatus for processing of tubular knitted fabric, including an internal flat spreader and width-adjustable edge drives, typically used in connection with other processing apparatus, such as calendars, padding equipment, compressive shrinking stations, etc. The apparatus utilizes a pre-loaded, resiliently biased spreader frame which, within its operating limits, presses outwardly against adjustably movable, opposed edge drive rolls. The spreader frame, which is positioned internally of the moving fabric tube during processing operations, is capable of in-process width adjustments, without either stopping the processing line or damaging the fabric. Width adjustment of the internal spreader frame may be accomplished from a remote operator station. Moreover, the apparatus may incorporate edge-sensing means operative automatically to adjust the width of the spreader to maintain uniformity of width in the processed fabric.

6 Claims, 7 Drawing Figures

ADJUSTABLE SPREADER FOR TUBULAR KNITTED FABRIC

This is a division of application Ser. No. 888,135, filed Mar. 20, 1978, now U.S. Pat. No. 4,192,045, granted Mar. 11, 1980.

BACKGROUND AND SUMMARY OF THE INVENTION

In the processing of tubular knitted fabric, it is common to pass the tubular fabric over an internal spreader, which distends the fabric tube laterally to relatively flat form and uniform width. When processed in "dry" condition, the fabric is often steamed while on the spreader, and then discharged directly into a processing station, such as a pair of calender rolls, a compressive shrinkage station, or the like. In some cases, the spread fabric is discharged from the spreader into a wet processing apparatus, such as a pad. Representative forms of prior art spreaders are reflected in, for example, the Robert Frezza U.S. Pat. No. 3,875,624 and in the S. Cohn et al U.S. Pat. No. 2,228,001. In those representative spreading apparatuses, a spreader frame comprises spaced, opposed spreader frame sections, typically carrying movable belts which engage the inner edge walls of the distended fabric.

At the transverse working axis of the spreader frame, there are provided opposed pairs of so-called radius rolls which engage through the fabric wall with grooved edge drive rolls. When the edge drive rolls are moved laterally into contact with a horizontally disposed spreader frame, the spreader frame is positioned and supported vertically and horizontally by the interengaging geometry of the external edge drive rolls and the internal pairs of radius rolls.

Typically, the width of a tubular fabric spreader is adjustably established by means of an internal spacer bar, extending from one side to the other of the frame along the transverse working axis, and various arrangements have been provided in the prior art apparatus for adjusting the length of the spacer bar. One advantageous form of such adjustment is reflected in the S. Cohn et al U.S. Pat. No. 2,228,001. The mechanism includes a movable latch lever, which may be gripped by the hand, to permit telescopic movement of elements of the spacer bar.

In prior art equipment of which the applicant is aware, it has always been necessary to stop the processing line in order to effect width adjustment of the spreader frame. This is required by the fact that the spreader is completely enclosed by the moving tubular fabric, and the only way that access can be gained to the internal mechanism is through the wall of the fabric. Once the processing line has been stopped, it is usually possible to manipulate the adjusting mechanism by distorting the wall of the fabric, working by "feel". In some cases, however, it is necessary to cut an opening in the fabric in order to make a width adjustment.

Even in cases where it has not been necessary to cut or distort the fabric, the practical problems involved in temporarily stopping the processing line for width adjustment of the spreader seriously discourage the making of any such adjustments during a processing run. In this respect, if the fabric is held motionless for a period of time in a processing stage, such as a calender, compactor or pad, the fabric may be off specification in the area exposed to excessive time in the processing stage, and may have to be cut out and discarded. Under the best of circumstances, width adjustment involves at least an undesirable and time-consuming interruption in an otherwise continuous processing operation.

Efforts in the past have been made to provide automatic adjustment by utilization of spring arrangements in conjunction with the spacer bar, urging the opposite side of the spreader frames in a separating direction. These arrangements have proved impractical, however, because effective spring force decreases markedly with increasing width, while, in general, greater force is required to retain the spreader frames at wider widths than at narrower widths.

Pursuant to the invention, a novel and improved spreader frame structure is provided, in which a relatively constant force yieldable means is provided for yieldably maintaining separation of the spreader frames, in a manner accommodating expansion and contraction of the spreader width, under the control of the external edge drive rolls, within a reasonable range of adjustment, and without excessive variation in contact pressure on the fabric wall which is interposed between the radius rolls and the edge drive rolls. More particularly, the apparatus of the invention includes a spreader frame in which the opposed spreader frame elements are connected by a telescopic spacer assembly, urged in an extending or widening direction by a so-called gas spring which, within the limits of its extension, has a reasonably uniform range of extending force. The arrangement is such that, within the range of operation of the telescoping spacer unit, the width of the spreader frame may be effectively controlled by increasing and decreasing the spacing of the external edge drive rolls. This may be accomplished as an in-process adjustment, either manually or from a remotely located control station. Moreover, the arrangement lends itself to automatic, continuous width monitoring and adjustment, in order to achieve greater uniformity in the processed width of the fabric.

In its simplest form, the spreader apparatus of the invention incorporates a telescopic spacer assembly, which extends between opposed spreader frame sections at the transverse working axis and serves to provide mechanical alignment of the frame sections to maintain the sections substantially in parallel relation. Associated with the telescoping assembly is an extendable gas spring unit, which is connected so as to be isolated from non-axial forces and which is contained within a telescoping type of housing structure, so as to be free of contact with the fabric passing over the spreader. Typically, a spreader or frame installation may be provided with a series of two or three spacer units of graduated size ranges covering the full width capacity of the processing line. The operating range of any one of the units is sufficient to accommodate automatic width adjustment during the processing of a given fabric, but it may be necessary or desirable to exchange spacer units when the processing line is set up to handle a different type or size of fabric, as will be understood. In this respect, the yieldable spacer units are adapted for quick-disconnect association with the primary spreader frame sections, so that changeover of the equipment for processing different types of fabric may be accomplished in an expedited manner.

In a particularly advantageous specific form of the invention, the yieldable telescopic spacer unit is comprised of a pair of telescopically interfitting tubular sections, which may be of irregular cross section, which serve not only to enclose and protect the gas spring unit, but also to provide mechanical support for the spreader frame sections against translational displacement. Where the tubular sections are of irregular cross section, they serve additionally to resist rotational displacement. In another advantageous form of the invention, structural support of the spreader frame sections is provided by spaced, telescopically associated elements straddling the gas spring element, and the entire telescopic structure, including the gas spring, is enclosed within a flexible, bellows-type housing.

For a more complete understanding of the above and other features and advantages of the invention, reference should be made to the following detailed description of a preferred embodiment and to the accompanying drawings.

DESCRIPTION OF PREFERRED EMBODIMENTS

Figure 1:
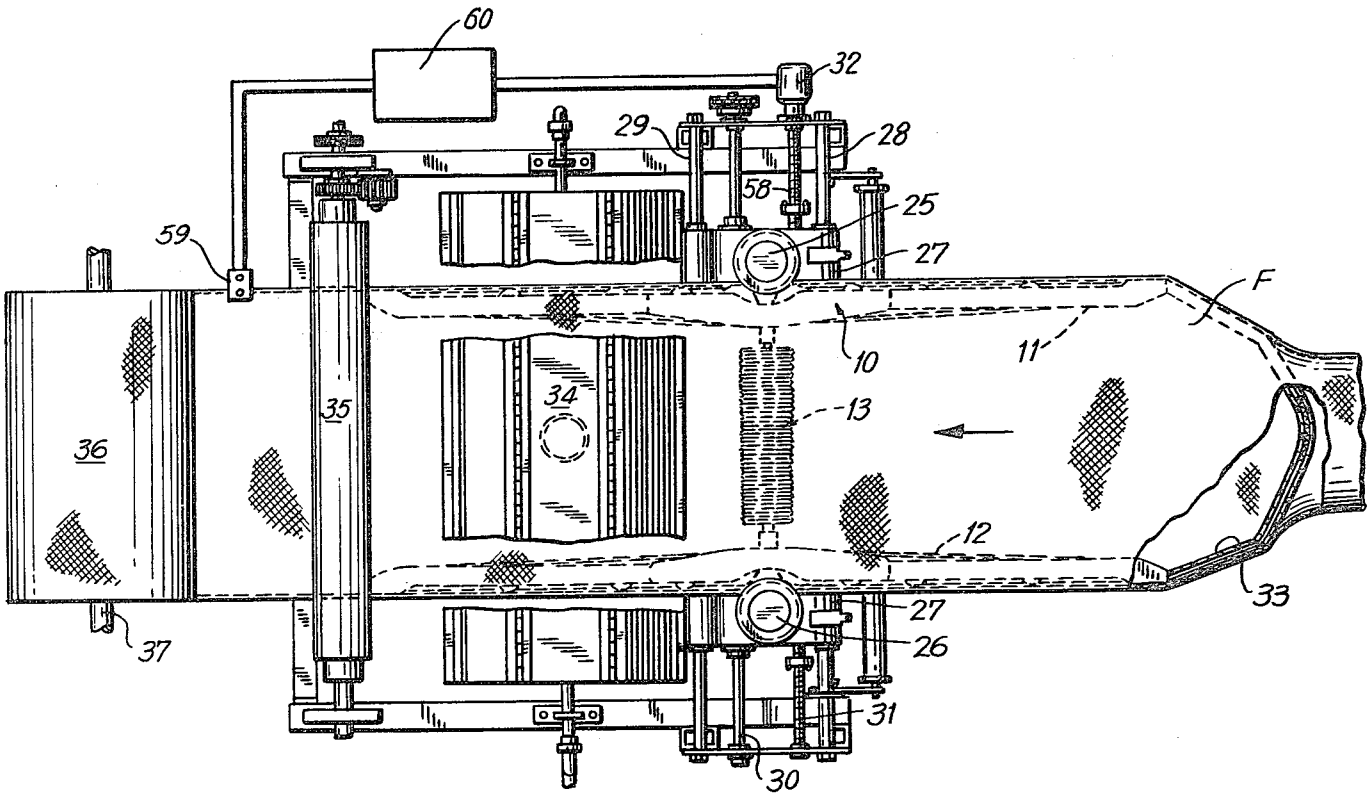
FIG. 1 is a top plan view of a fabric finishing line incorporating an automatically adjustable spreader frame arrangement in accordance with the invention.

Referring now to the drawings, and initially to FIG. 1 thereof, there is shown a typical finishing line for tubular knitted fabric, which is operative to spread the fabric to flat form and uniform width, steam and then calender the spread fabric, and then wind the fabric as it emerges from the calender station. A spreader frame 10 (see FIG. 2) is comprised of spaced, opposed spreader frame sections 11, 12 joined centrally by a spacer assembly, generally designated by the numeral 13, to be described in further detail. The respective spreader frame sections 11, 12 include central brackets 14, 15 mounting spaced pairs of radius rolls 16, 17. Frame extensions 18, 19 and 20, 21 extend in opposite directions from the respective brackets 14, 15 and mount a plurality of guide pulleys 22. The guide pulleys 22 and the radius rolls 16, 17 mount respective pairs of upstream belts 23 and downstream belts 24, which are engageable with internal edges of a tubular knitted fabric passing over the spreader frame assembly.

In accordance with known principles, the pairs of radius rolls 16, 17 are convexly contoured on their outer peripheries, for reception within concavely contoured outer peripheries of external edge drive rolls 25, 26. The arrangement is such that, when the edge drive rolls are moved into firm engagement with the respective pairs of radius rolls, the entire spreader frame is both positioned and supported by the edge drive rolls.

As illustrated in FIG. 1, the edge drive rolls 25, 26 are mounted on carriages 27 slidably supported on transverse guide rods 28, 29. A splined shaft 30 is slidably associated with the carriages 27 and is arranged to be driven by an external power source (not shown) to rotate the edge drive rolls 25, 26 at predetermined controllable speeds. The edge drive carriages 27 are also connected to a screw shaft 31, which is oppositely threaded at each end and is controllably rotatable by means such as a motor 32. When the shaft 30 is rotated, the edge drive carriages 27 are moved inwardly or outwardly, as the case may be, in unison, with respect to the longitudinal center line of the equipment.

When the edge drive rolls are in supporting engagement with the pairs of radius rolls 16, 17, rotation of the edge drive rolls, acting through a fabric wall, will cause rotation of the radius rolls 16, 17 and corresponding movement of the upstream and downstream belts 23, 24. Pursuant to known principles, the downstream radius rolls may be more deeply grooved than the upstream rolls, so that the downstream belts will travel at a somewhat lower rate of speed than the upstream belts. When this is done, the fabric is controllably overfed onto the downstream section of the spreader, from the upstream section, which is desirable in many cases.

In the specific apparatus illustrated in FIG. 1, the spreader frame is provided with a flexible wire lead-in section 33. The incoming fabric tube is applied over the lead-in section, distended laterally, and engaged internally by the upstream belts 23. Thereafter, the fabric is controllably drawn onto the spreader frame and advanced by movement of the belts. After entering the downstream section of the spreader frame, the fabric typically passes through a steaming section 34, which may be of known construction, and may typically thereafter pass through a calendering stage 35, comprising a pair of opposed calender rolls which apply rolling pressure to the fabric. The particular processing operation, however, is not significant to the invention, and it should be understood that the spreading section may deliver the fabric to any one of a variety of processing operations. In the illustrated system, the calendered fabric enters a winding stage 36, where it is wound around a core rod 37 for convenient subsequent handling.

In accordance with past practice, spacer bar assemblies incorporated with the spreader frames have been arranged to lockingly secure the spreader frame in any pre-set width-adjusted position. After pre-setting the width of the spreader, the spreader is positioned between the edge drive rolls, which are then controllably moved toward each other sufficiently to engage and mechanically support the spreader frame. The inward adjustment of the edge drive rolls is, of course, carefully done so as not to apply excessive transverse pressure to the spreader frame, and in some prior equipment, provisions are made for controllably limiting the amount of such pressure by the utilization of a controllably stalled drive motor 32 and/or switch means associated with the carriage positioning mechanism. In any case, the width of the spreader frame was previously established, and the edge drive rolls were brought into engagement with the pre-set frame.

In accordance with the present invention, however, a unique and novel arrangement is provided for yieldably separating the spreader frame sections 11, 12, such that the working width of the spreader frame, in operation, is determined by the position of the edge drive rolls 25, 26, within the operating limits of the spacer assembly 13.

Figure 2:
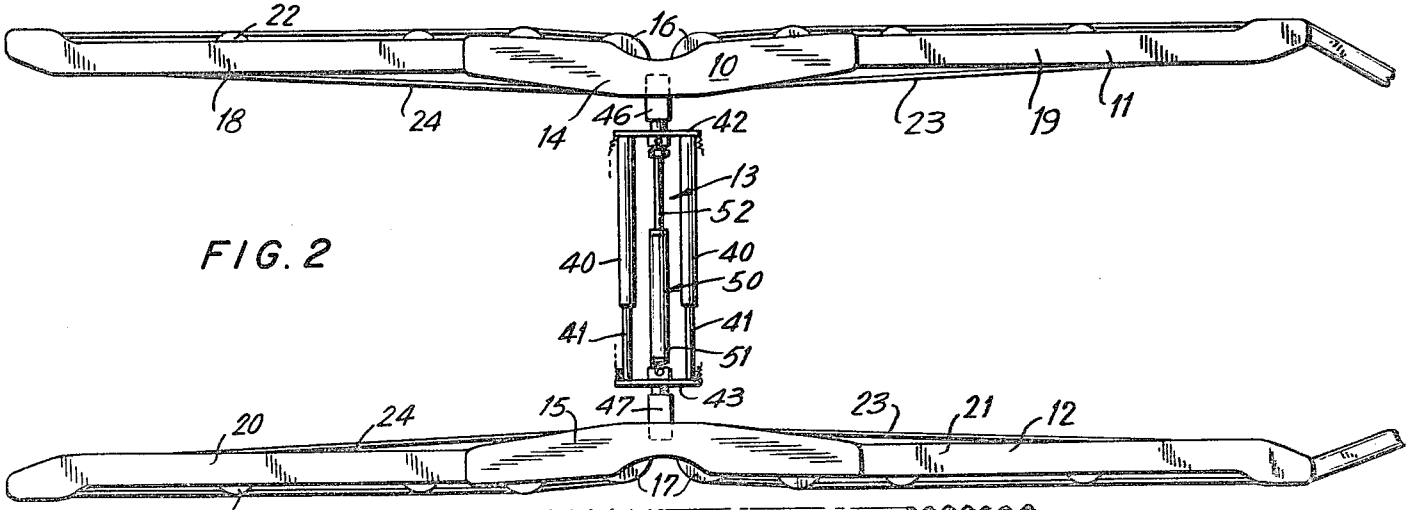
FIG. 2 is a top plan view of a spreader frame of the type incorporated in the processing line of FIG. 1.
Figure 3:
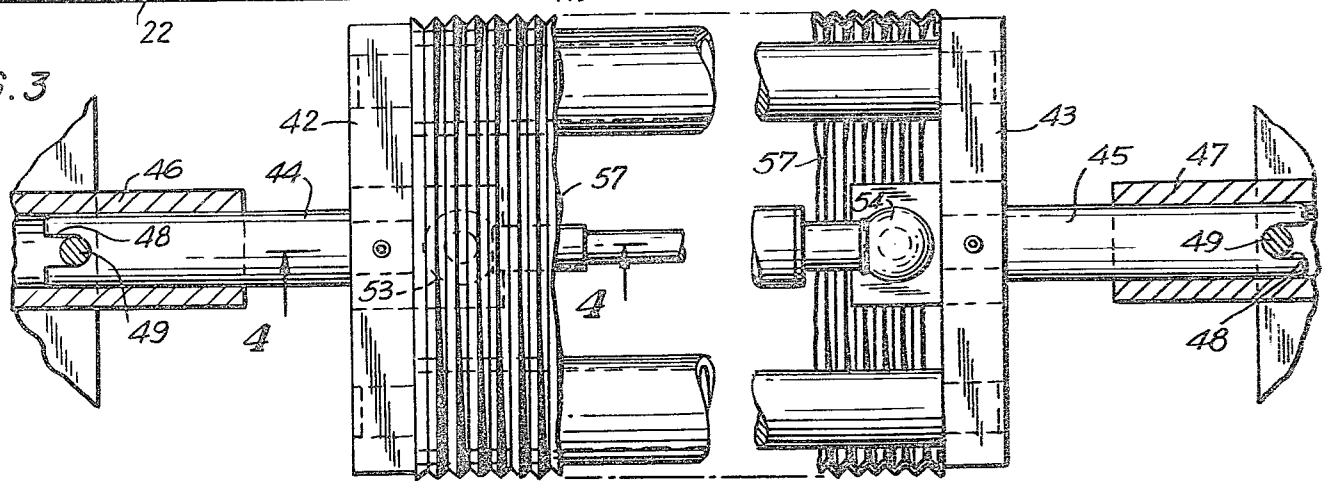
FIG. 3 is an enlarged, fragmentary view of a resilient spacer unit constructed in accordance with the teachings of the invention and adapted for incorporation in the apparatuses of FIGS. 1 and 2.
Figure 4:
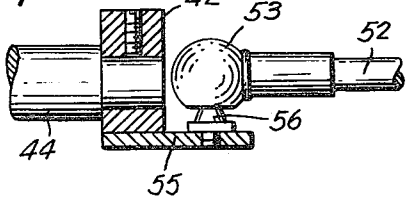
FIG. 4 is a fragmentary cross sectional view as taken generally on line 4—4 of FIG. 3.

Referring now more particularly to FIGS. 2–4, the spacer bar assembly 13 comprises a spaced pair of telescopically interfitting tubes 40 and rods 41. At one end, the tubes 40 are rigidly secured to a yoke bar 42, and at the opposite side, the rods 41 are secured rigidly to a similar yoke bar 43. Connecting pins 44, 45 are secured to and extend outwardly from the respective yoke bars 42, 43 and are arranged to be telescopically received within sleeves 46, 47 mounted rigidly on the respective spreader frame sectons 11, 12. As shown in FIG. 3, the outer ends of the connecting pins 44, 45 are provided with outwardly opening slots 48 arranged for the reception of pins 49 extending diametrically across the insides of the tubular coupling sleeves 46, 47. The fit between the connecting pins 44, 45 and their respective coupling sleeves 46, 47 is relatively close, such that when the pins are inserted into the sleeves and engaged with the pins 49, the spacer bar assembly serves to support the spreader frame sections 11, 12 against swinging movement toward and away from each other at either end and also against rotational motion around the transverse working axis through the spacer bar assembly assuring that the spreader frame sections 11, 12 are at all times retained in substantially parallel relation, if that is desired, or at least in a predetermined, coplanar relation. The respective spreader frame sections may move toward and away from each other, within the telescoping limits of the tubes and rods 40, 41, but will otherwise remain in a constant relationship.

Pursuant to a significant feature of the invention, the spacer bar assembly 13 is constantly urged in an extending or frame-widening direction, within pre-set limits, by means of a so called gas spring unit 50, which is a device in the nature of an air cylinder, having a cylinder body 51 and rod 52. The gas spring unit may be of the type made commercially available as of the filling date hereof by Gas Spring Coporation, 17 Commerce Drive, Montgomeryville, Pa. In general, the gas spring unit is in the form of a sealed gas cylinder, pre-charged with a positive gas pressuure and having controlled flow passage means connecting opposite sides of the piston. Under the pre-charged, permanent gas pressure, an unbalanced force is acting at all times to urge the piston and rod in an extending direction. There being a somewhat greater effective area at the closed end of the cylinder than at the rod end, in any position of the rod 52, within the limits of its travel, the pre-pressurized internal gas will continue to exert a net outward or extending force on the rod. Inasmuch as the effective area is slightly less on the rod side than on the closed side, there will be a slight decrease in gas pressure as the piston and rod moves in an extending direction, and a slight increase in pressure as the piston and rod move in the retractive direction. By appropriate selection of the relative diameters of the cylinder 51 and rod 52, the pressure differential can easily be held within acceptable limits. For example, with a gas spring unit having a cylinder diameter of 22 mm and a rod diameter of 10 mm, the reduction in pressure between fully retracted and fully extended positions may be on the order of 20–25%, over an extension of as much as 260–300 mm.

Inasmuch as the gas spring unit 50 should be as free as possible of non-linear forces, it is connected to the spacer bar assembly 13 by ball and socket joints 53, 54. As reflected in FIG. 4, for example, the yoke bars 42, 43 are provided with short, inwardly extending brackets 55, to which a secured ball posts 56 forming part of the ball and socket joints. The arrangement is such that the linear axis of the gas spring unit is substantially aligned with the connecting pins 44, 45.

In the apparatus of FIGS. 1–4, the entire telescopic mechanism of the spacer bar 13 is enclosed within a flexible bellows housing 57, so that the cloth is isolated from the mechanism and vice versa.

Figure 5:
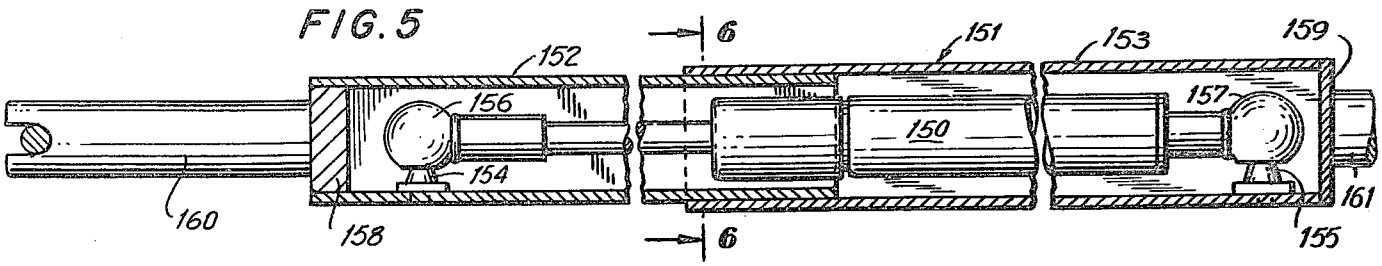
FIG. 5 is a longitudinal cross section view of a modified form of resiliently biased spacer unit for incorporation in the apparatuses of FIGS. 1 and 2.
Figure 6:
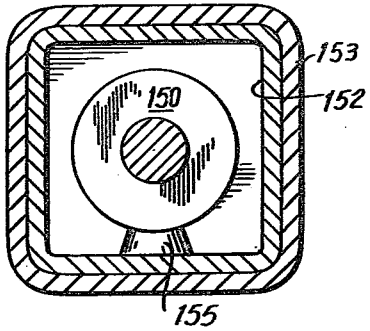
FIG. 6 is a cross sectional view as taken on line 6—6 of FIG. 5.

A modified form of the spacer post assembly is illustrated in FIGS. 5 and 6 of the drawing. In the modified form, a gas spring unit 150 is housed within a tubular telescopic assembly 151. The telescopic assembly is comprised of inner and outer tubular elements 152, 153 which are slideably received one within the other. The respective tubular members 152, 153 of complementary, irregular cross section, typically square, so as to be restricted against relative rotation. Ball posts 154, 155 are mounted in the closed ends of the respective tubular sections 152, 153 and are engaged with sockets 156, 157 of the gas spring unit 150. End plates 158, 159 are welded or otherwise secured to the ends of the tubular sections, and these in turn mount slotted connecting pins 160, 161.

The modified spacer bar unit of FIGS. 5 and 6 functions the same as the unit of FIGS. 1–4, but is generally more compact and more easily handled. The telescoping tubular sections 152, 153, in the embodiment of FIGS. 5 and 6, serve a multiple function of providing mechanical support against swinging and rotating movement of the spreader frame section, and of housing and protecting the gas spring unit 150. The modification of FIGS. 5 and 6 is advantageous for many commercial applications of the invention, because its small size enables it to be easily handled and stored.

Figure 7:
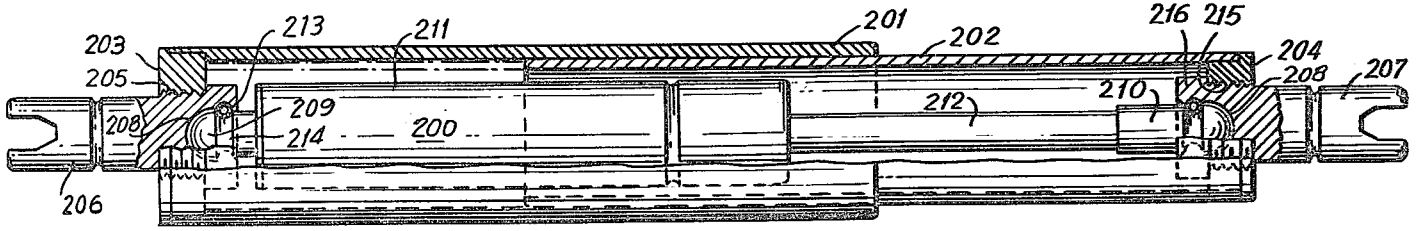
FIG. 7 is a longitudinal cross sectional view of a further modified form of resiliently biased spacer unit for incorporation in the apparatus of FIGS. 1 and 2.

In FIG. 7, there is shown a further modified form of the invention, which is of highly simplified and economical construction and ideally suited for typical commercial utilization. The unit of FIG. 7 includes a gas spring element 200, which is housed within telescopically interfitting tubular guide sleeves 201, 202. In the illustration of FIG. 7, guide sleeves 201, 202 are of circular cross section, in which case they do not resist rotational displacement of the spreader frame elements to which they may be connected. In practice, rotational resistance may be unnecessary in many instances, inasmuch as the spreader frame sections will tend to be held in the proper geometric relationships by engagement with the edge drive rolls and/or other elements of the processing line.

Secured to the opposite ends of the tubular guide sleeves 201, 202 are end caps 203, 204 provided with threaded openings 205 for the reception of end-slotted connecting pins 206, 207. The inner ends of the connecting pins 206, 207 are provided with semi-spherical sockets 208 for the reception of semi-spherical end fittings 209, 210 provided respectively on the closed end 211 and the operating rod 212 of the gas spring element 200. The end fittings 209, 210 are arranged to slip freely into the sockets 208, and are held loosely therein by split roll pins 213 or the like which are inserted in bores provided therefor in the connecting pins 206, 207. Portions of the roll pins 213 project into annular grooves 214 in the gas spring end fittings, so as to maintain a loose connection.

In the assembly of the device of FIG. 7, the connecting pins 206, 207 are first attached to the ends of the gas spring element 200 and loosely fixed thereto by means of the roll pins 213. Thereafter, the telescopically fitting tubular guide sleeves 201, 202 are applied over the opposite ends of the unit, causing the ends of the connecting pins to project outward through the threaded openings 205 in the end caps. The base portion of each of the connecting pins is threaded at 215 and shouldered at 216, such that the pin may be threadedly joined to the end caps 204 to form a secure and complete assembly.

In the assembled relationship, the length of the inner telescoping tubular section 202 is such that it bottoms against the opposite end cap 204 at least a short distance prior to bottoming of the operating rod 212 of the gas spring. This prevents the gas spring element, which may be fairly delicate in construction, from having to resist the full closing force of the edge drive rolls, in the event the equipment were accidentally to be adjusted to the narrow limit position of the unit.

In either of the embodiments of FIGS. 5–6 or 7, the telescopic tubular sections advantageously may be formed of a material such as aluminum, which in turn may be coated on the working surfaces with a friction-reducing material such as "Tufram" or the like.

For a typical processing installation, a spreader frame assembly according to the invention likely would include a single pair of spreader frame sections 11, 12 and a series of two or perhaps three spacer bar units 13 arranged for interchangeable assembly with the spreader bar section and each covering a given range of width variation. In setting up the equipment for processing fabric of a given width, the spreader frame sections are assembled with a spacer bar unit of an appropriate width range. When initially assembled, the spreader frame would, of course, be at the maximum width of the range, because the gas spring unit 50 would be fully extended. The assembled spreader is then positioned between the edge drive rolls 25, 26 and the edge drive rolls are then brought together, into contact with the radius rolls 16, 17, in order to position and support the spreader frame. Thereafter, the spreader may be set to the precise desired width by moving the edge drive rolls 25, 26 further inward by appropriate rotation of the threaded shaft 31.

Desirably, adjustable stop means are provided to limit subsequent outward movement of the edge drive carriages, such that the edge drive rolls are not separated farther than the expansion limit of the spreader frame assembly. Any suitable arrangement may be provided for this purpose, such as the provision of an adjustable stop collar 58 on the shaft 31, arranged either to stall the motor 32 or to cooperate with a switch or other control device to terminate its motion when a predetermined maximum width limit is reached.

One of the outstanding advantages of the new apparatus is the ability of the operator to adjust the width of the spreader as an in-process adjustment, for optimum control over the finished width of the fabric. As will be appreciated, tubular knitted fabric is subject to a large number of variables in its construction and processing, so that there can be considerable variation even between supposedly similar fabrics, and it is not always possible to predict accurately the width at which a spreader frame should be set in order to achieve a desired finished width in the fabric. Utilizing the mechanisms of the invention, the spreader frame may be initially set to an approximate width, and the processing commenced. The operator is then able to observe the actual condition of the processed fabric and determine whether any further adjustment in width is required. If so, he is able to make precise adjustments in the fabric width by manipulating the edge drive roll carriages 27 slightly inward or slightly outward, as needed.

By appropriately locating controls for the edge drive carriages, it is possible for an operator to station himself at an appropriate process point for observation of the fabric while width adjustments are being made in the spreader frame. In the past, it has been necessary for the operator to stop the processing line and physically manipulate the spacer mechanism for the spreader frame, either by feeling through the wall of the fabric, or, in some cases, by actually cutting an opening in the fabric to gain access to the spacer adjusting mechanism. As will be readily appreciated, stoppage of the processing line under such circumstances for minor adjustment by the operator is inconvenient and so therefore the operator may be restrained from accomplishing this function.

With the apparatus of the invention, it is also possible to provide for continuous monitoring and automatic adjustment of the finished width of the fabric. For this purpose, a photocell or other sensing device 59 may be positioned adjacent to the wind-up station 36, or at some other appropriate stage of the process, in a position to sense the location of the fabric edge. If at any time the fabric edge wanders out of a predetermined tolerance range, the sensor 59 actuates a control circuit 60, energizing the motor 32 to either increase or decrease the spacing of the edge drive rolls 25, 26, as indicated by sensor 59.

In any of its forms, the apparatus of the invention represents a significant advance in the art of processing tubular knitted fabric involving spreading to width. In this respect, the processing of knitted fabric by various techniques, which include the step of spreading the fabric to flat form and predetermined width, is an old and well developed art. Nevertheless, it has been impracticable heretofore to make in-process width adjustments, because of the fact that the spreader frame is completely enclosed within the moving fabric tube. The mechanism of the present invention, utilizing a gas spring actuator, having relatively constant force throughout its full range of extension, enables the width of the spreader frame and hence the width of the processed fabric to be regulated and varied as an in-process adjustment, by controlling the position of the edge drive roll carriages 27. In a typical installation, a series of two or more self-adjustable spacer bar assemblies may be provided, adapted for quick interchange with the spreader frame sections, so that the proper range of width adjustment may be accommodated when setting up the equipment to handle a specific type and size of fabric.

Additional important advantages are derived from the invention by reason of the fact that the in-process width adjustment may be easily accomplished from a remote location, enabling the operator to make adjustments from a suitable observation point, such as the point at which the processed fabric is being gathered by winding, folding, etc. Additionally, the equipment lends itself to continuous, automatic edge-sensing of the finished fabric, such that automatic width adjustment of the spreader frame may be accomplished. This enables extremely uniform finished fabric to be produced with a minimum of operator attention and a maximum of efficiency in the overall processing operation.

In its several forms, the apparatus of the invention enables the spreader frame to be of very lightweight construction, yet adequately strong to withstand service in a commercial production line. Lightness of weight is important because the entire weight of the spreader frame assembly must be supported by the edge drive rolls, acting through the fabric wall, and excessive weight and/or pressure could mark sensitive fabrics.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A variable width spreader apparatus for processing tubular knitted fabric, which comprises (a) a pair of width adjustable edge drive carriages, (b) means for moving at least one of said carriages toward and away from the other to effect width adjustment, (c) edge drive rolls mounted on said carriages and movable therewith, (d) opposed longitudinally extending spreader frame elements for reception of the interior of the tubular knitted fabric, (e) each of said spreader frame elements having intermediate its ends a pair of support rollers engageable through a fabric wall with an edge drive roll, in straddling relation therewith, (f) said edge drive rolls and said support rollers having generally complementary contours, whereby said spreader frame elements are supported and positioned by said edge drive rolls, (g) spacer means extending between and engaging said spreader frame elements, (h) said spacer means comprising telescopically associated guide members accommodating movement of the spreader frame elements toward and away from each other, (i) said spacer means further comprising a gas spring element engaging said guide members and constantly urging said guide member in an extending direction, (j) said spreader frame members being movable toward and away from each other by in-process adjustment of the spacing of said edge drive rolls, (k) said telescopically associated guide members comprising interfitting tubular members, (l) said gas spring being mounted within and housed by said tubular members, and (m) said tubular members being of a complementary irregular cross section, whereby to be non-rotatable one with respect to the other.

2. A variable width spreader apparatus according to claim 1, further characterized by (a) the complementary irregular cross section of said tubular members being rectangular.

3. A variable width spreader apparatus according to claim 1 further characterized by (a) said gas spring element comprising a piston within a sealed gas cylinder pre-charged with a positive gas pressure.

4. A variable width spreader apparatus according to claim 1 further characterized by (a) said spacer means having a quick-detachable association with said spreader frame elements, whereby to facilitate interchangeability of spacer means of different length.

5. A variable width spreader apparatus according to claim 1 further characterized by (a) at least one of said carriages having controllable drive means for moving said carriage toward and away from the other as an in-process adjustment, (b) means for continuously sensing the edge location of the processed fabric at a location downstream of the spreader frame, and (c) control means responsive to said sensing means for effecting in-process adjustment of the spacing at least one of said edge drive rolls on said carriages in response to wandering of said edge location beyond predetermined limits.

6. A variable width spreader apparatus according to claim 5, further characterized by (a) said spacer means having an expansion-contraction capability less than the width adjustment capability of said edge drive rolls.

* * * * *